United States Patent [19]

Eddy

[11] Patent Number: 4,483,501

[45] Date of Patent: Nov. 20, 1984

[54] HOLSTER HOLDER

[75] Inventor: Tillman L. Eddy, West Palm Beach, Fla.

[73] Assignees: Christopher D. Wright, North Palm Beach; Bernard F. O'Hara, Palm Beach Gardens; Michael L. O'Hara, West Palm Beach, all of Fla.

[21] Appl. No.: 494,432

[22] Filed: May 10, 1983

[51] Int. Cl.[3] ..... F16M 11/00

[52] U.S. Cl. ..... 248/205.1; 224/198; 5/503; 5/508

[58] Field of Search ..... 248/205 R, DIG. 14, 248/DIG. 6; 5/503, 508; 224/911, 311, 42.42, 198, 243; D22/13; 16/DIG. 13

[56] References Cited

U.S. PATENT DOCUMENTS

| | | | |
|---|---|---|---|
| 1,531,423 | 3/1925 | Simpson | 248/DIG. 6 |
| 1,718,878 | 6/1929 | Raquette | 248/DIG. 6 |
| 1,969,258 | 8/1934 | Cross . | |
| 2,328,421 | 8/1943 | Carlson | 248/DIG. 6 |
| 2,406,587 | 8/1946 | Cooper | 248/DIG. 6 |
| 2,557,674 | 6/1951 | McRae | 248/95 |
| 2,917,213 | 12/1959 | Bucheimer | 224/911 |
| 3,117,708 | 1/1964 | Goldman | 224/911 |
| 3,734,439 | 5/1973 | Wintz | 248/311.2 |

FOREIGN PATENT DOCUMENTS

| | | | |
|---|---|---|---|
| 686700 | 3/1965 | Italy | 16/DIG. 13 |

*Primary Examiner*—Ramon S. Britts
*Assistant Examiner*—Robert A. Olson
*Attorney, Agent, or Firm*—Harvey B. Jacobson

[57] ABSTRACT

An elongated first stiff panel is provided and includes a second panel supported from one end thereof by an integral "living hinge". The second panel has a plurality of bores formed therethrough arranged in a circular pattern wherein each bore has a corresponding diametrically opposite bore in the pattern of bores. A bar overlies one side of the second pattern and includes opposite end bores formed therethrough registrable with diametrically opposite bores formed in the second panel and fasteners are removably secured through the bores in the opposite ends of the bar and corresponding diametrically opposite bores formed in the panel. The fasteners are removable and the bar may be angularly displaced and resecured to the second panel in adjusted angular position relative thereto about an axis disposed normal to the second panel and passing through the center of the aforementioned circular pattern. At least the center portion of the bar is spaced from the opposing side face of the second panel in order that a portion of the support loop of a gun holster may be passed between the bar midportion and the opposing second panel. The first panel is equipped with longitudinally and transversely spaced bores or apertures through which attaching fasteners may be secured in order to mount the first panel against a suitable support surface.

6 Claims, 5 Drawing Figures

HOLSTER HOLDER

BACKGROUND OF THE INVENTION

Most individuals who own a handgun for protection also own a holster in which the handgun may be received. Further, most holsters include belt loops thereon whereby the holster may be supported from a belt surrounding the waist of the user of the gun.

In addition, many owners of handguns are desirous of at least temporarily storing their handguns in a "ready" position while they are in their homes, automobiles or places of business. Accordingly, a need exists for structure whereby the holster in which a handgun is received may be supported in a readily accessible position. Therefore, a further need is present for structure by which a handgun holster may be supported in desired position from various different types of support structures such as a bed, desk or counter.

BRIEF DESCRIPTION OF THE INVENTION

The holster holder of the instant invention has been designed to provide a means whereby a handgun holster may be supported in "ready" position from various different support structures which may be found in numerous different environments. The holster holder may be constructed of inexpensive materials and marketed at a low cost in order that the user of a handgun may afford more than one holster holder or support from which the holster for his handgun may be supported in the desired "ready" position.

The main object of this invention is to provide a holster holder for support of a handgun therefrom and with the holder constructed in a manner whereby it may be suitably supported from various different support structures found in different environments.

Another object of this invention is to provide a holster holder in accordance with the preceding object and construction in a manner whereby the holster to be supported therefrom may be supported from the holster in various different positions relative to the holder.

A still further object of this invention is to provide a holster holder including structural features which adapt the holder to be supported from various different support structures without being fastened thereto.

A final object of this invention to be specifically enumerated herein is to provide a holster holder in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully described and claimed, reference being had to the accompanying drawings forming a part hereof, wherein like numerals refer to like parts throughout.

DETAILED DESCRIPTION OF THE INVENTION

Figure 1:
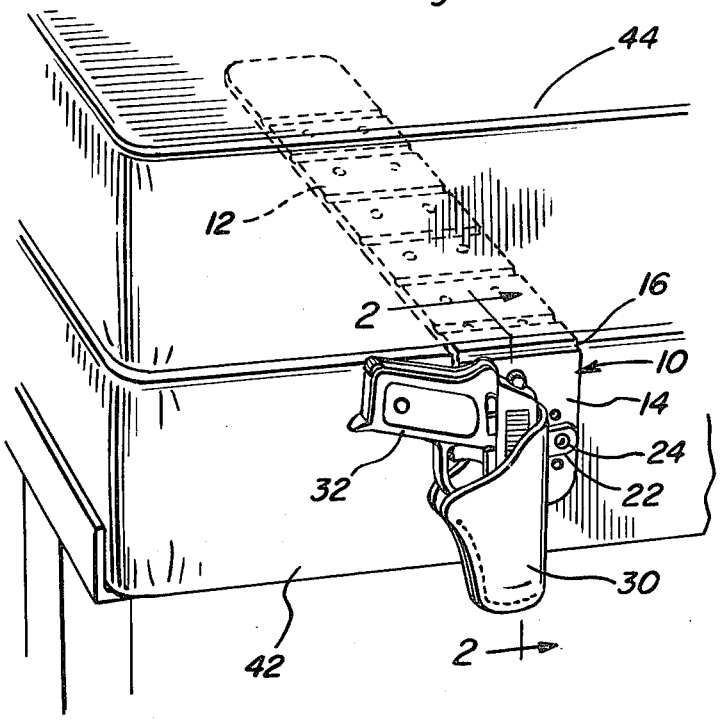
FIG. 1 is a fragmentary perspective view of a bed illustrating the manner in which a handgun may be supported from one end of the bed in "ready" position through utilization of the holster holder of the instant invention.
Figure 2:
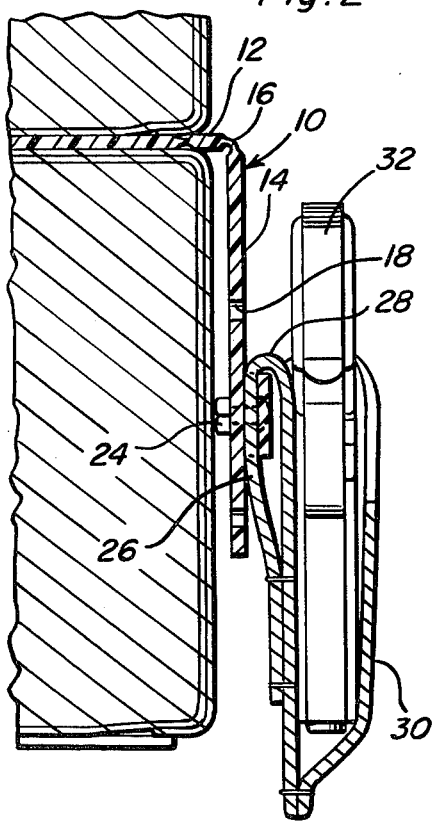
FIG. 2 is an enlarged fragmentary vertical sectional view taken substantially upon the plane indicated by the section line 2—2 of FIG. 1.
Figure 3:
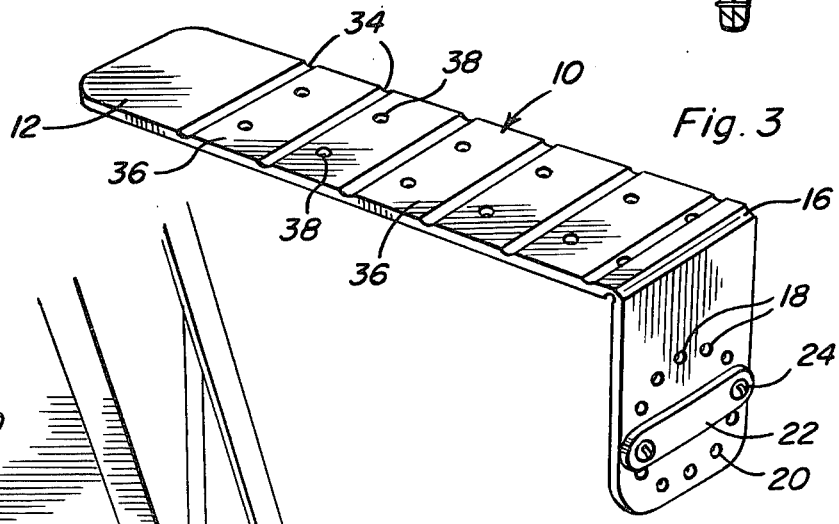
FIG. 3 is a perspective view of the holster holder.

Referring now more specifically to the drawings, the numeral 10 generally designates the holster holder of the instant invention. The holster holder 10 includes a first elongated panel 12 which may be constructed of suitable plastic material and from one end of which a second panel 14 is supported. The panel 14 is formed integrally with the adjacent end of the panel 12 through the utilization of an integral reduced thickness zone 16 which defines a "living hinge". Accordingly, the second panel 14 may be angularly displaced relative to the first panel 12 about an axis extending along the reduced thickness zone 16. It will be noted that the reduced thickness zone 16 extends transversely of the corresponding end of the first panel 12.

The second panel 14 includes a plurality of bores 18 formed therethrough and the bores 18 are arranged in a circular pattern 20 of bores. Each bore 18 includes a corresponding diametrically opposite bore 18 and a bar 22 is provided with opposite end bores through which threaded fasteners 24 are secured. The threaded fasteners 24 are spaced apart a distance equal to the spacing between diametrically opposite bores 18 and accordingly, the fasteners 24 may be secured through any selected pair of diametrically opposite bores 18. Thus, the bar 22 may be supported from the second panel 14 in adjusted angular position relative thereto about an axis disposed normal of the second panel 14 and passing through the center of the pattern 20.

The bar 22 may be slightly bowed or include offset end portions so that the longitudinal midportion of the bar 22 is spaced at least slightly from the opposing face of the second panel 14.

After the bar 22 has been mounted upon the second panel 14, the space between the bar 22 and the opposing surface of the second panel 14 may receive a portion 26 of the belt loop 28 of a handgun holster 30 in which a handgun 32 is supported. In this manner, the holster 30 may be conveniently supported from the panel 14 in various adjusted positions relative thereto.

Figure 4:
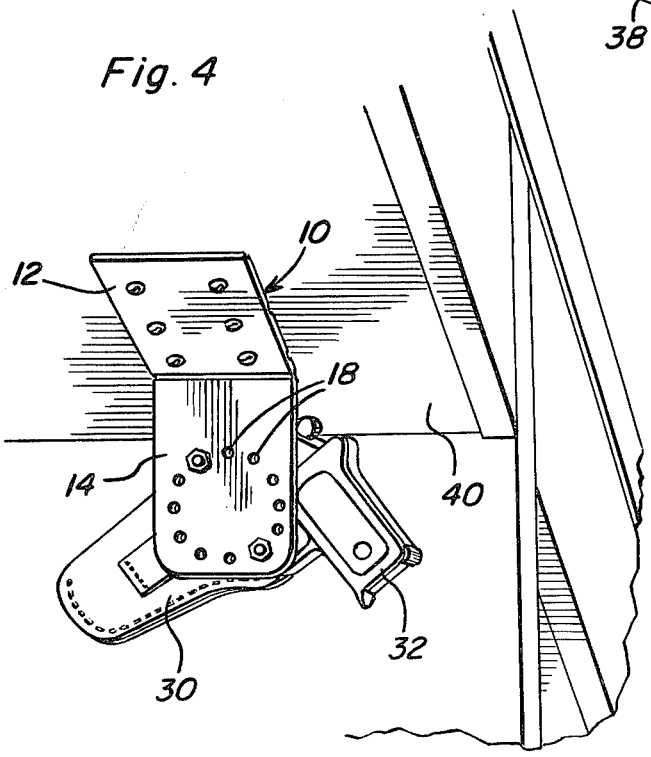
FIG. 4 is a fragmentary perspective view illustrating the manner in which the holster holder may be secured beneath a counter or desk portion and have a holster supported therefrom with a handgun in the holster disposed in "ready" position.
Figure 5:
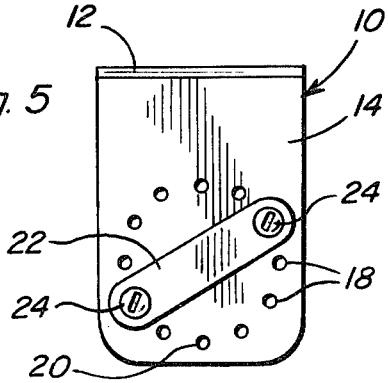
FIG. 5 is an end elevational view of the holster holder illustrating the manner in which the holster support bar thereof may be adjustably angularly displaced relative to the panel of the holster from which the bar is supported.

The first panel 12 includes longitudinally spaced transversely extending zones 34 of reduced thickness along which the first panel 12 may be bent, cut or broken in order to shorten the first panel 12 as desired. In addition, each of the areas 36 of the first panel 12 between the zones 34 thereof is provided with a pair of bores 38 through which suitable fasteners may be secured in order to fasten the first panel 12 to a suitable support structure such as the underside 40 of a desk, counter or table in the manner illustrated in FIG. 4 of the drawings. It will be noted from FIG. 4 that the first panel 12 has been foreshortened at the third zone 34 thereof spaced from the zone 16.

With attention now invited more specifically to FIG. 1 of the drawings, it will be noted that the first panel 12 may be inserted between the box spring 42 and mattress 44 at one end of a bed and that the handgun 32 within the holster 30 supported from the holder 10 is supported in "ready" position.

Other than the short bar 22 and the fasteners 24, the holster 10 is constructed of a single piece of plastic material suitable for forming the "living hinge" along the zone 16. The zones 34 may be defined in the first panel 12 by forming a plurality of grooves in the panel 12 on only one side thereof while the zone 16 may be formed by forming registered grooves in opposite sides of the panel 12.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A holster and holster holder combination for supporting a gun within the holster from various support structures and with the supported gun in a position for ready access and use, said holder including a first elongated stiff panel, a second stiff panel hingedly supported from one end portion of said first panel for angular displacement relative thereto about an axis generally paralleling said panels and extending transverse of said first panel, an elongated bar, attaching means removably attaching the opposite end portions of said elongated bar to said second panel with said bar generally paralleling and overlying one side of said second panel and having at least its longitudinal midportion slightly spaced from said one side face for reception of a portion of a holster support loop between said bar and second panel, said second panel including a circular pattern of a plurality of bores formed therethrough with each bore in said pattern being diametrically opposite another bore of said pattern, said attaching means including elongated fastener means removably secured through opposite ends of said bar and diametrically opposite bores of said pattern, said holster including a belt loop through which the midportion of said elongated bar extends.

2. The holster holder in claim 1 wherein said first and second panels are integrally formed and joined by a reduced thickness zone extending transversely of said one end of said first panel comprising a "living hinge" for support of said second panel from said first panel.

3. The holster holder of claim 1 wherein said first panel includes longitudinally spaced bores formed therethrough whereby said first panel may be mounted upon a support surface to which removable fasteners pass through said bores may be secured.

4. The holster holder in claim 3 wherein said first panel includes longitudinally spaced zones thereof separated from adjacent longitudinally spaced zones by reduced thickness intermediate zones of said first panel extending transversely thereof and each of said zones between intermediate zones of reduced thickness include at least one of said bores formed therethrough.

5. The holster holder of claim 1 wherein said first panel includes longitudinally spaced zones of reduced thickness extending transversely thereof along which said first panel may be broken.

6. The holster holder of claim 5 wherein said first and second panels are integrally formed and joined by a reduced thickness zone extending transversely of said one end of said first panel comprising a "living hinge" for support of said second panel from said first panel.

* * * * *